United States Patent [19]

Sauer

[11] Patent Number: 4,548,114

[45] Date of Patent: Oct. 22, 1985

[54] TOOL FOR NOTCHING AND SLITTING TUBING

[76] Inventor: Craig A. Sauer, R.R. 2 Box 213, Wilton, Iowa 52278

[21] Appl. No.: 646,923

[22] Filed: Sep. 4, 1984

[51] Int. Cl.[4] ..... B26D 3/14; B26D 3/16; B26D 9/00

[52] U.S. Cl. ..... 83/391; 83/406; 83/444; 83/467 A; 83/519; 83/692; 83/54; 30/92.5

[58] Field of Search ..... 30/92.5, 90.4, 90.6; 83/54, 406, 408, 440, 440.1, 441, 441.1, 444, 580, 519, 692, 683, 917, 467 A, 391

[56] References Cited

U.S. PATENT DOCUMENTS 3,988,826 11/1976 Heikkala ..... 30/92.5 X
4,194,422 3/1980 Williams ..... 83/917 X

FOREIGN PATENT DOCUMENTS 2294812 7/1976 France ..... 83/54

*Primary Examiner*—James M. Meister
*Attorney, Agent, or Firm*—Glenn H. Antrim

[57] ABSTRACT

A cylindrical body resembling a piece of pipe has the sharp edge of a utility-knife blade extending into the bore of the body to cut a longitudinal slit in the wall of a piece of plastic tubing that is pushed or pulled through the bore. A removable stop protruding into the bore momentarily stops the piece of tubing until another utility blade, connected to a guide and handle positioned at an angle across the cylindrical body, is pulled into the slitted end of the tubing to cut on a line that intersects the longitudinal slit. A pointed angular piece is thereby cut out and removed to leave in the end of the piece of tubing a notch with a surface slanting outward toward the end of the piece of tubing for functioning as an inclined plane to spread the tubing. A linkage connected between the angular guide and the stop removes the stop to permit completion of slitting. A handle with a triangular blade is also connected transversely to the cylindrical body for cutting the slitted tubing into lengths.

5 Claims, 8 Drawing Figures

TOOL FOR NOTCHING AND SLITTING TUBING

BACKGROUND OF THE INVENTION

This invention relates to tools for notching and slitting tubing and particularly to a tool for use in fabricating guards for guy wires by using one utility blade for slitting and another utility blade for a short diagonal end cut to complete a notch.

A slitting tool having a blade extending into the opening through a sleeve to be pulled along a piece of plastic tubing is shown in U.S. Pat. No. 3,988,826 issued to Arvid E. Heikkala on Nov. 2, 1976. Punches, such as shown in U.S. Pat. No. 4,194,422 issued to David A. Williams on Mar. 25, 1980 have been used to notch the ends of pieces of tubing.

Tools similar to that for slitting tubing have been used to slit end portions of insulating coverings of electrical cables to facilitate their removal. The notching punches have been used to cut annular notches in preparation for joining pieces of tubing at an angle.

Manufacturers have prepared, at substantial cost resulting from marketing and delivery, brightly colored pieces of split and notched tubing to be applied around the lower ends of guy wires attached to poles of electrical transmission lines. Since brightly colored plastic tubing used in fabricating the guards is like that used prevalently in plumbing and is readily available at relatively low cost from widely located distributors, electrical utilities can readily purchase the tubing, and by using a suitable tool economically split and notch the tubing for application to guy wires.

SUMMARY OF THE INVENTION

The present tool is operated manually to complete three operations for converting economically long lengths or rolls of plastic tubing into guards for guy wires. The tubing is slit, notched, and cut into desired lengths. The slitting of the tubing along the full length for a guard is done in two steps. A beginning portion is slit, and then a slanting cut is made in the end of the tubing to complete a notch before the rest of the length is slit.

The tool has an elongated main body with a longitudinal bore through which the tubing is manually pushed and pulled into a beginning end of the bore and out a finishing end. A common utility blade secured at a position intermediate the ends of the body has a cutting edge extending into the bore sufficiently to cut through the wall of the tubing. A removable stop extending into the bore stops the initial movement of the tubing through the bore after a short length of the forward end of the tubing is slit.

Another utility blade for notching is secured to an operating member that is connected to the body opposite the stop. The operating member for notching is longitudinally, reciprocally, manually movable to pull the blade for cutting through an opening or angular slot in the main body in an angular direction, preferably, 45 degrees with respect to the axis of the tubing. Starting from the end of the tubing while it is against the stop, an angular slit is cut to meet the previously cut longitudinal slit. A cut-out pointed section leaves an angular notched portion at the end of the tubing to be pressed against a guy wire, the slanting cut functioning as an inclined plane to spread the tubing apart at the slit gradually from the notched end to the opposite end for positioning the entire length of tubing about the wire or cable.

After the notch is cut, the stop is removed from the bore of the body through operation of a linkage connected between the stop and the operating member of the notching blade. The tubing is then pulled through the bore to continue cutting of the longitudinal slit by the slitting blade. As the length of the longitudinal slit approaches being almost as long as the desired length of a piece of tubing, a cut-off assembly near the beginning end of the body is manually operated to cut through the tubing. The nearly slit piece of tubing is then pulled out of the main body to complete the longitudinal slit.

The cut-off assembly has a blade connected to a pivoted handle that is rotated forward and downward like the handle of a paper cutter. A sharp edge of the blade is slanted downward and forward with respect to the handle and is forced by operation of the handle through a slit in a reinforcing flange about the body and through the tubing. Through the use of this tool, one person can produce about 200 guy guards per hour and with one helper, about 600 guy guards per hour.

DESCRIPTION OF THE PREFERRED EMBODIMENT

Figure 1:
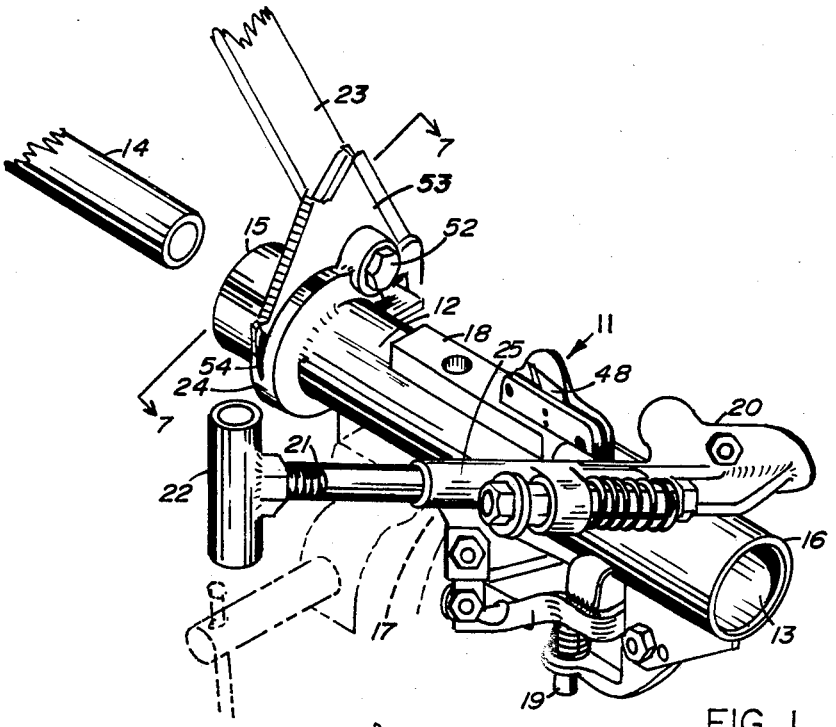
FIG. 1 is a side view of the present tool for notching and slitting tubing.

A preferred embodiment of the tool 11 for slitting and notching as shown in FIG. 1 has a main, generally cylindrical body 12 with a longitudinal bore 13. The body may be made from two sections of iron pipe having an inside diameter slightly greater than the outside diameter of plastic tubing 14 that is to be used for fabricating guy wire guards. The tubing 14 is a sliding fit within the bore 13 and is to be inserted into the bore 13 at the end 15, that for convenience of description is called the beginning end, and is to be withdrawn from the finishing end 16. An iron bar 17 for supporting the tool 11 such that handles described below are in a convenient position, has a side welded on a longitudinal line at an intermediate position of a portion that is considered to be the bottom of the main body 12. Conveniently, the bar 17 is gripped by a bench vise to secure a longitudinal axis of the main body in a horizontal position.

Figure 6:
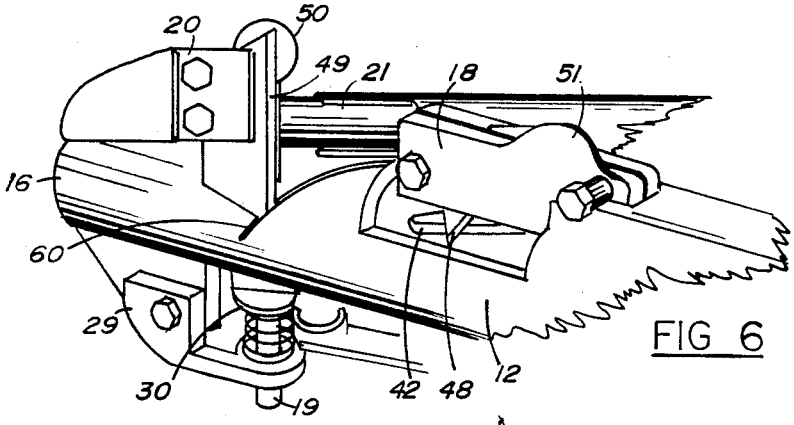
FIG. 6 is a fragmentary top oblique view of the finishing end of the tool to show a notching blade, a slitting blade, and an arm for operating the latching mechanism.

FIG. 1 shows locations of main components as described below. In order of operation, a support 18 for a slitting blade is located above the supporting bar 17 at the top of the main body intermediate the beginning end 15 and the finishing end 16. As a piece of tubing 14 is nserted in the beginning end 15 and pushed inward, the end of the piece of tubing 14 is pushed past a sharp edge of the slitting blade held by the support 18 for slitting the wall of the tubing. The slitting operation is momentarily stopped when the forward end of the piece of tubing 14 contacts the upper end of the stop pin 19 that s projecting upward into the bore 13. The pin 19 as shown in FIG. 1 is located between the support 18 for a slitting blade and the finishing end 16. A notching blade is connected by a plate 20 to a rod 21 that is longitudinally movable by a handle 22. The rod 21 is a sliding fit within a sleeve 25 secured at a slant across the top of the main body 12 such that a notching blade can be drawn through a slot 60 (FIG. 6) slantingly into the end of a piece of tubing that is against the stop 19. A cut-off assembly for cutting the tubing 14 to a desired length ncludes a handle 23 and a flange 24 located about the beginning end 15 of the main body 12.

Figure 2:
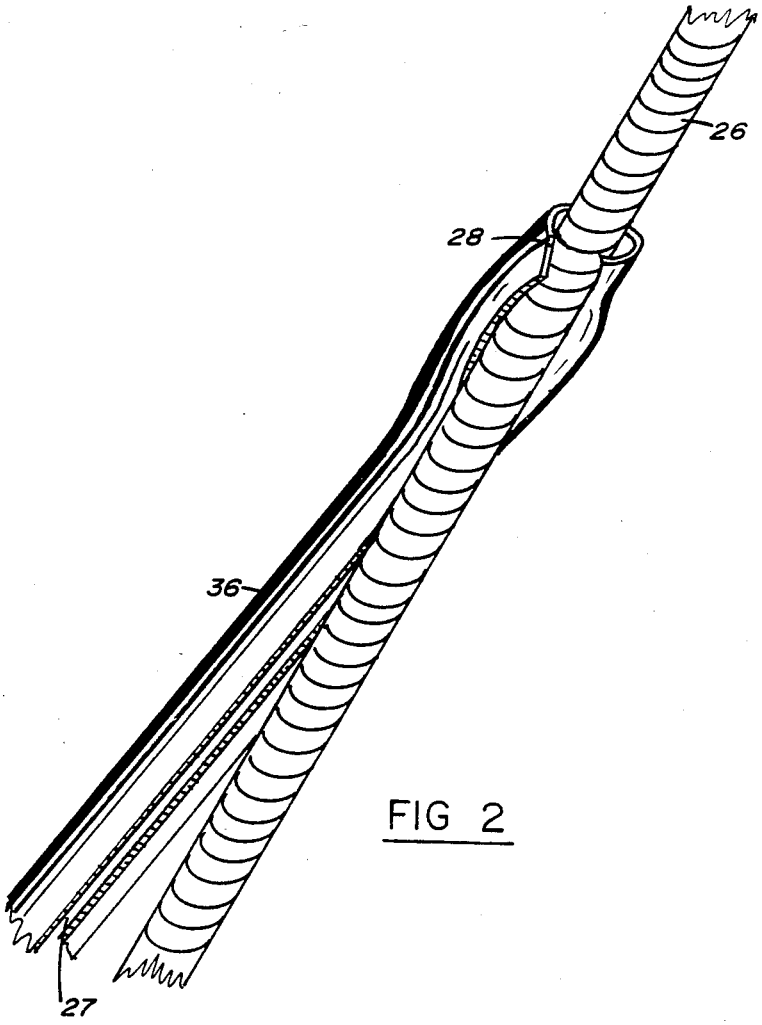
FIG. 2 shows application of a notched end of tubing to a guy wire.

In FIG. 2, the notched end of a completed guy guard 36 is shown being started on a guy wire 26. At first, the surface 28 of the notch that has been cut at a 45 degree angle with respect to a radial plane of the tubing 25 is pressed against the cable 26 so as to act as an inclined plane for spreading apart the adjacent slitted edges of the guard 36 sufficiently to start the end of the tubing about the cable 26 as shown in FIG. 2. The edges of the longitudinal slit 27 are then somewhat curved about the guy wire 26, and continued, progressive pressure on the tubing 25 opposite the slit somewhat below the portion of the slit 27 spread about the cable readily forces the guy guard 36 completely about the guy wire 26. The material of the tubing 14 may be one of the several plastics that is readily cut by a sharp edge, can be formed under pressure, and returns after an interval to its original shape when the pressure is removed.

Figure 3:
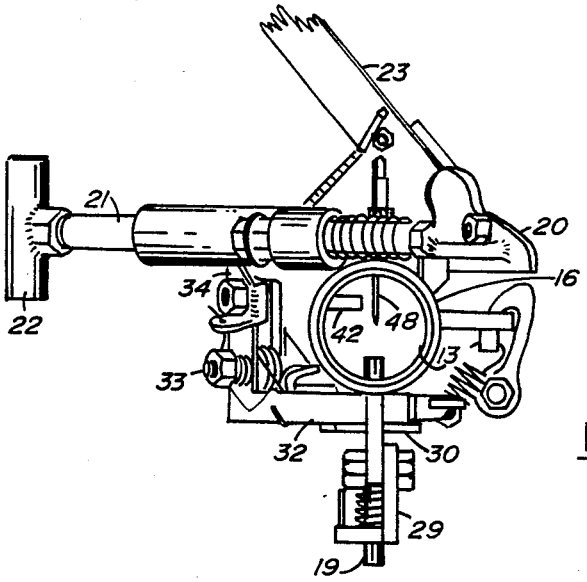
FIG. 3 is a finishing end view of the tool to show a stop assembly.
Figure 4:
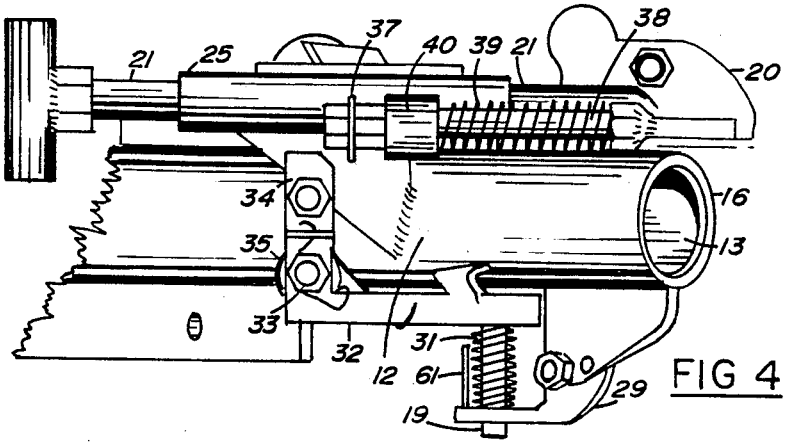
FIG. 4 is a fragmentary side view of the finishing end of the tool to show linkage operating the stop of the stop assembly.

With reference to FIGS. 3 and 4, the upper end of the pin 19 above a radial projection 30 is a sliding fit within a hole through the bottom of the main body 12 for positioning the upper end of the pin 19 within the bore 13. A supporting member 29 extends downward from the bottom of the main body 12 and then horizontal to terminate in a ring through which the lower end of the pin 19 is a sliding fit. A helical compression spring 31 is positioned about the pin 19 between the outer end of the supporting member 29 and the intermediate radial projection 30 of the pin 19 for normally urging the pin 19 upward for positioning its upper end into the bore 13. The distance of downward travel of the pin 19 is limited by a smaller pin 61 extending upward from the ring at the end of the support 29 toward the projection 30.

When the end of a piece of tubing 14 has been notched and is ready to be moved beyond the stop 19 to the finishing end 16, the upper end of the pin 19 is removed from the bore 13 by operation of a lever 32 in response to the return of the actuating rod 21 after it has been pulled outward to cut the slanting surface 28 (FIG. 2) in the end of the tubing 14. The intermediate, projecting portion 30 of the pin 19 has an upper surface in the path of travel of the lower end of the lever 32. The lever 32 is connected by a pivot 33 to the main body 12 and extends upward from the pivot toward a guide 38 connected to the rod 21 to which a slitting blade is connected. The guide 38 is a rod parallel to the operating rod 21 and is a sliding fit through a bearing 40 secured to the outer surface of the sleeve 25 in which the operating rod 21 slides. A helical compression spring 39 about the guide 38 and between the bearing 40 and the supporting plate 20 to which one end of the guide 38 is connected, urges the notching blade held by the plate 20 to a position outside the bore 13.

The upper end of the lever 32 has an upward extending pawl 34 having its lower end pivotally connected to the upper end of the lever 32. The vertical edge of the pawl opposite the plate 20 is straight whereas the facing edge is curved upward and toward the upper end of the straight edge. A spring 35 normally urges the pawl 34 against a stop for positioning the straight edge vertically to prevent the upper tip of the vertical edge from being tilted in the direction toward the plate 20. The end of the guide 38 opposite the plate 20 has a projection or washer 37, the peripheral portion of which has a path of travel in line with the upper tip of the pawl 34. As the operating rod 21 is pulled outward by the handle 22, the projection 37 engages the curved edge of the pawl 34, and the pawl 34 is allowed to be rotated by the spring 35 to let the projection 37 pass without moving the lever 32. The spring 35 returns the pawl 34 to its normal vertical position so that when the operating rod 21 is being returned to its normal inward position, the projection 37 encounters the straight edge of the pawl 34, and because it is stopped from rotating in one direction, the lower end of the lever 32 is moved downward. The lower end of the lever 32 presses downward on the projection 37 to move the pin 19 downward sufficiently to remove its upper end from the bore 13.

Figure 5:
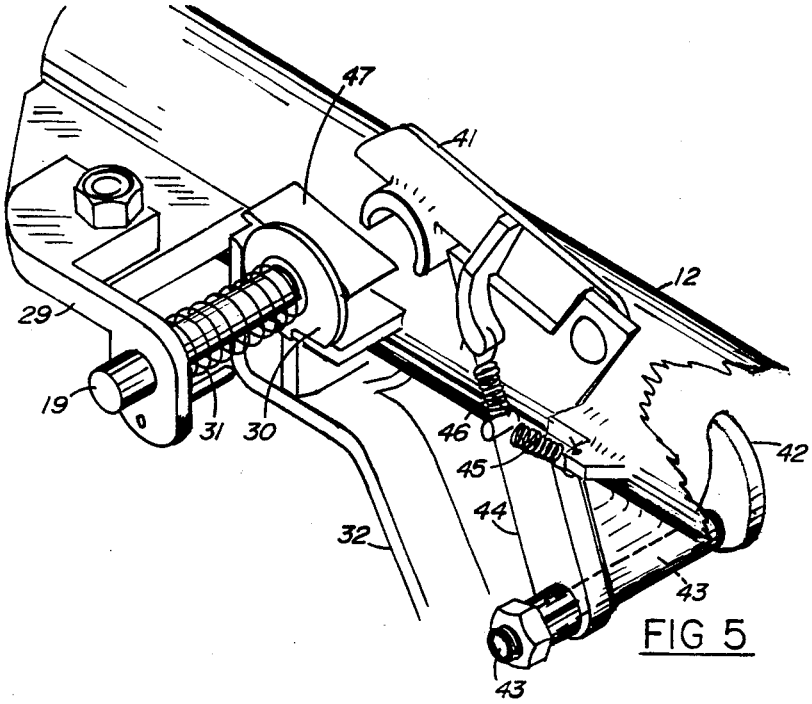
FIG. 5 is a fragmentary bottom oblique view of the finishing end to show latching mechanism for retaining the stop in an outward position.

When a piece of tubing 14 is not present within the bore 13, the stop-pin 19 is withdrawn only momentarily while the projection 37 presses against the pawl 34 as the rod 21 is being returned to its inward position. In order to retain the stop-pin 19 downward such that a piece of tubing into which a notch has just been cut can be pressed toward the finishing end 16, a catch 41 shown in FIG. 5 is operated by a lever 42 shown in FIG. 6 to hold the pin 19 downward. The tip of the lever 42 extends into the bore 13, and as long as it is not being pressed outward by contact with the wall of the piece of tubing 14, the catch 41 is spaced horizontally a short distance from the radial projection 30 about the stop-pin 19. As the forward end of a piece of tubing 14 is being pushed past the lever 42, the end of the lever 42 is pressed outward to rotate a small vertical shaft 43 (FIG. 5) to which it is attached. The shaft 43 is rotatable within a bearing secured to the main body 12 and extends downward to be secured to a lever 44 that is a portion of linkage that operates the catch 41 in response to movement of the lever 42. A helical, tension spring 45 connected between the main body 12 and the lever 44 at a point spaced from the shaft 43 urges the lever 44 to a position in which the catch 41 is spaced from the radial projection 30. Nevertheless, relative to the lever 44, the catch 41 is urged toward the projection 30 by a spring 46. The end of the catch 41 opposite that end for engaging the projection 30 is pivotally connected to the outer end of the lever 44, and the spring 46 is connected to urge the catch 41 in a direction toward the stop-pin 19 until it encounters a stop, the stop being spaced a short distance from the pivotal connection between the catch 41 and the lever 44.

Opposite the engaging portion of the catch 41, the radial projection 30 has near its periphery an upward extending small plate 47 to be contacted by the catch 41. The intermediate projection of the stop-pin 19 has a vertical radially extending portion positioned within a vertical slot of a tab depending from the main body 12 to prevent rotation of the stop-pin 19 and the plate 47.

The height of the plate 47 is somewhat less than the distance of travel of the stop-pin 19 such that normally when the presence of a piece of tubing operates a lever 44 to press the catch 41 against the plate 47, the plate 47 slides with respect to the catch 41 so as not to inhibit movement of the stop-pin 19. However, when the stop-pin 19 is moved momentarily down almost to its lower limit, a portion of the catch 41 is moved inward by the spring 46 over the top of the plate 47 for holding the pin 19 downward. The stop-pin 19 is therefore held downward until a piece of the tubing 14 is pulled out the finishing end 15 past the tip of the lever 42. The spring 45 then removes the catch 41 from over the plate 47 of the projection 30 for permitting the stop-pin 19 to be moved upward by the spring 31.

The support 18 (FIG. 6) for a slitting blade 48 comprises a rigid plate secured upright to the top of the main body 12 and a removable plate secured to the rigid plate by two small machine screws. The slitting blade 48 to be held between the plates of the support 18 is a usual blade for utility knives and may have the usual two or three notches in the edge opposite its sharp cutting edge. The removable plate of the support has a pair of spaced pins for engaging the notches of the selected blade. The pins are mounted at an angle to engage the notches for positioning the cutting edge toward the beginning end 15 of the main body 12 and slanting downward from the vertical somewhat toward the opposite or finishing end 16.

The supporting plate 20 for a notching blade 49 is similar to the support for the slitting blade in that it has a plate fixed to the end of the rod 21 and a removable plate with two locating pins and is attached to the plate on the rod by two machine screws. The sleeve 25 (FIG. 4) is at a 45 degree angle with respect to the axis of the bore 13, and the notching blade 49 (FIG. 6) enters the end of the piece of tubing 14 at an angle of 30 degrees with respect to the vertical plane of the longitudinal cut. Preferably, the cut for the slanting edge 28 (FIG. 2) extends a little past the longitudinal slit 27 to insure that the angular piece is fully cut and to provide greater flexibility to that portion of the end opposite the slanting edge 28. A stop (not shown) to hit an end of the sleeve 25 is provided by the interconnection between the rod 21 and the guide 38 for stopping the notching blade 49 shortly after it has intersected the longitudinal slit 27.

As in a utility knife, the slitting blade 48 and the notching blade 49 can be positioned with a different notch or notches engaging positioning pins such that the blades extend different distances into the bore 13. Since the different distances result in different portions of the cutting edges contacting the wall of a piece of tubing 14, changing the distances to expose a new portion of the edge is as effective as changing blades. The tool is very economical in the use of blades because a large number of guards can be prepared while each blade 48 or 49 is in one position. At least one of the adjacent plates of the supports 18 and 20 have a raised portion 50 and 51 respectively to function as guards to protect a user from the unused points of the respective blades.

Figure 7:
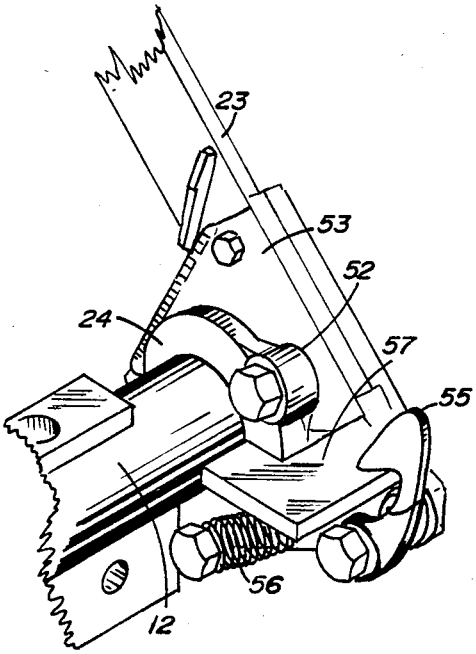
FIG. 7 is a side view of the beginning end of the tool to show a cut-off assembly.

With respect to FIG. 7, a triangular plate 53 has the side corresponding to a base connected to the handle 23 of the cut-off assembly, and the blade 53 and handle 23 are pivotally connected to the main body 12 by a pin or bolt 52 such that when a handle 23 is rotated downward, an angular sharp edge of the blade 53 is moved through a slot 54 (FIGS. 1 and 8) to cut through a piece of tubing 14 within the bore 13. For safety, a catch-arm 55 is pivotally connected to the main housing 12 and is urged by a spring 56 toward a catch-bar 57, the catch-bar extending perpendicularly from the adjacent end of the handle 23. The upper end of the catch-arm 55 is pushed manually away from the catch-bar 57 to permit operation of the handle 23.

Figure 8:
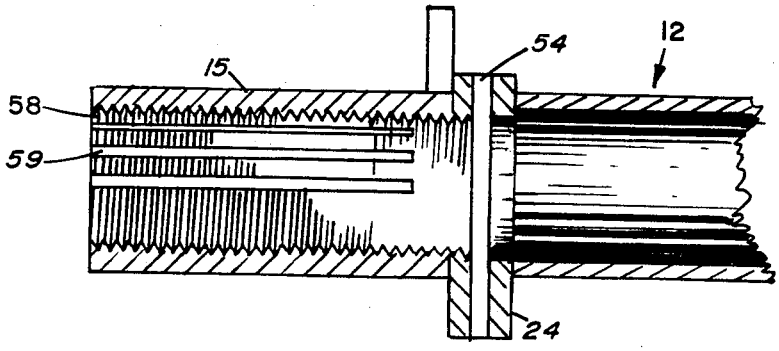
FIG. 8 is a longitudinal cross-sectional view of the beginning end of the tool on line 7—7 of FIG. 1.

In order that a piece of tubing 14 is tightly gripped while it is being cut by the blade 53, the beginning end 15 of the main body 12 as shown in FIG. 8. has annular grooves 58 and longitudinal grooves 59. The grooves are preferably on both sides of the slit 54 in which the cut-off blade 53 travels completely across the bore 13. In order to provide maximum gripping, the inside diameter of the beginning end 15 is small enough to provide a tight fit about a piece of tubing 14 to ensure that sharp edges of the grooves 58 and 59 hold the piece of tubing 14 for a clean cut. The annular grooves 58 may be conveniently usual internal threads, and the longitudinal grooves 59 may be provided only in the longitudinal portion against which the piece of tubing 14 is pressed during cutting by the blade 53. The remainder of the bore 13 toward the finishing end 16 may have a slightly longer diameter.

The cut-off blade 53 can be readily made by modifying a usual blade for a sickle-bar mower. One or both of the usual mounting holes may be enlarged, and for safety one of the angular cutting edges that faces an operator may be rounded. The opposite edge used for cutting is beveled a greater extent than usual and sharpened carefully to provide a good edge for cutting plastic.

I claim:

1. A tool for slitting and notching plastic tubing comprising:

an elongated body having a longitudinal bore therethrough and fastening means for rigid stationary support thereof, said bore having an inside dimension slightly more than the outside dimension of said tubing, said body having a beginning end in which a piece of said tubing is inserted into said bore and a finishing end from which said piece of said tubing is removed, a slitting blade secured to said body at a position intermediate said ends thereof to extend on a longitudinal plane into said bore, a sharp cutting edge of said blade being directed toward said beginning end, a stop connected to said body at a position between said slitting blade and said finishing end of said body, said stop being movable between a first position within the bounds of said bore and a second position outside a line of movement of said piece of tubing through said bore, means for moving said stop between said first and second positions thereof, said stop initially being in said first position, said slitting blade being positioned to cut a longitudinal slit on said longitudinal plane in an end of said piece of tubing as said end of said piece is pushed within said bore from the beginning end of said body until said end of said piece contacts said stop, a notching blade, said body having an opening to permit said notching blade to be pulled toward said beginning end on a slanting line at an acute angle with respect to said longitudinal slit, guiding and operating means connected between said body and said notching blade for pulling said notching blade along said slanting line, said guiding and operating means and said opening for said notching blade being positioned longitudinally on said body relative to said stop and therefore relative to said end of said piece of tubing against said stop such that said notching blade upon being pulled contacts first said end of said piece of tubing at a point within a central portion of a quadrant adjacent said longitudinal slit and cuts from said point a slanting slit on said slanting line toward said longitudinal slit, said guiding and operating means being restrained in distance of movement to stop movement of said notching blade shortly after said slanting slit reaches said longitudinal slit and therefore when an acutely pointed cutout is cut from said end of said piece of said tubing, and means for moving said stop to said second position thereof for permitting passage of said piece of tubing through said bore for completing said longitudinal slit along the full length of said piece of said tubing.

2. A tool for slitting and notching plastic tubing as claimed in claim 1 wherein said stop is a pin, said pin being a sliding fit within a hole of said body for longitudinal movement on a radial line of said bore, a spring supporting member connecting said stop to said body, said spring supporting member having a supporting end spaced from said body, a compression spring disposed between said supporting end and an intermediate portion of said pin for urging said pin inward with respect to said bore to said first position, a radial projection from said intermediate portion of said pin, a stop-operating lever having one end positioned to contact said projection of said pin for moving said pin outward from said bore to said second position, a pawl pivotally connected on the opposite end of said stop-operating lever, a projection secured to said guiding and operating means having during movement of said notching blade a path of travel in line with an end of said pawl, said pawl merely being rotated on said stop-operating lever while said guiding and operating means is pulled in the direction to cut said end of said piece of tubing but being effective to move said stop-operating lever in response to movement of said guiding and operating means in an opposite direction after said slanting slit is cut, and said stop-operating lever while moving in response to movement of said guiding and operating means in said opposite direction moving said pin into said second position for permitting said piece of tubing to be moved through said bore.

3. A tool for slitting and notching plastic tubing as claimed in claim 2 having a stop-catch assembly for engaging said stop to hold said stop in said second position until said piece of tubing is moved past said slitting blade, said stop-catch assembly comprising:

a catch-operating lever pivotally connected to said body, said catch-operating lever having a first end extending through an opening of said housing and being urged to extend into said bore, a catch pivotally connected to a second end of said catch-operating lever, said catch being positioned adjacent said projection of said pin but normally not in contact therewith, said piece of tubing upon being inserted into said bore pressing against said first end of said catch-operating lever to urge said catch against said projection to prepare said catch for engagement with said projection of said pin, and said catch in response to said pin being moved to said second position engaging said projection to retain said pin in said second position until said piece of tubing is moved past said first end of said catch-operating lever.

4. A tool for slitting and notching plastic pipe as claimed in claim 1 having a cut-off blade assembly, said cut-off blade assembly comprising:

a cut-off lever, one end of said cut-off lever functioning as a handle, the opposite end of said lever being pivotally connected at a point spaced from said bore and rotatable about said pivot in a plane transverse to said bore and located between said slitting blade and said beginning end of said body, a cut-off blade fastened to said cut-off lever at a position for a leading sharp edge of said blade to intersect said bore as said cut-off lever is rotated about said pivot, a flange about said body having a central radial portion in the path of travel of said cut-off blade as said cut-off lever is rotated toward said body, said flange and said body having a reinforcing and guiding slot in the path of said cut-off blade, said slot being slightly wider than said cut-off blade and having sufficient depth to permit said cut-off blade to completely transverse said bore for cutting off said piece of tubing.

5. A tool for slitting and notching plastic pipe as claimed in claim 4 wherein at least a portion of said bore within said beginning end of said body adjacent said flange provides a tight sliding fit for said piece of said tubing, said bore within said beginning end at least adjacent said flange where said piece of tubing is pressed during operation of said cutoff lever having inside annular grooves and intersecting longitudinal grooves to form a gripping surface.

* * * * *